United States Patent [19]

Ando

[11] Patent Number: 4,957,158

[45] Date of Patent: Sep. 18, 1990

[54] HEAT EXCHANGER

[75] Inventor: Nobuyasu Ando, Takasaki, Japan

[73] Assignee: Sanden Corporation, Isesaki, Japan

[21] Appl. No.: 472,638

[22] Filed: Jan. 30, 1990

[30] Foreign Application Priority Data

Jan. 30, 1989 [JP] Japan ..... 1-8229[U]

[51] Int. Cl.[5] ..... F28F 9/02

[52] U.S. Cl. ..... 165/110; 165/173; 165/176; 165/178; 29/890.035

[58] Field of Search ..... 165/173, 175, 178, 176, 165/174, 111

[56] References Cited

U.S. PATENT DOCUMENTS 3,978,687 9/1976 Calzadilla ..... 165/178

4,589,265 5/1986 Nozawa ..... 165/176

*Primary Examiner*—Albert W. Davis, Jr.

*Attorney, Agent, or Firm*—Banner, Birch, McKie & Beckett

[57] ABSTRACT

A heat exchanger for use in an automobile air conditioning system including inlet and outlet union elements is disclosed. The heat exchanger comprises a plurality of flat tubes for conducting refrigerant and a plurality of corrugated fins fixedly sandwiched between the flat tubes. The flat tubes and the corrugated fins jointly form a heat exchange region. First and second header pipes are fixedly and hermetically connected to the flat tubes and communicate with the interior of the tubes. The header pipes are also provided with inlet and outlet union elements for connecting the heat exchanger to other external elements of the air conditioning system. Each of inlet and outlet union elements includes a rectangular parallelpiped block having a cavity formed therein. Each of the blocks is generally located at a coner of the heat exchanger defined by the top and bottom ends of the header pipes and the heat exchanger region. The cavity formed in the block allows fluid communication between the hollow interior of the header pipe and the interior of a pipe member which links the heat exchanger to external elements of the air conditioning system. The hollow interior of the flat tubes which are located in the top and bottom end portions of the heat exchange region also communicate with the cavity through holes formed in the parallelpiped block.

16 Claims, 12 Drawing Sheets

HEAT EXCHANGER

TECHNICAL FIELD

The present invention relates generally to heat exchangers, and more particularly, to a heat exchanger for use in an automotive air conditioning system.

BACKGROUND OF THE INVENTION

With reference to FIGS. 1–5, one prior art embodiment of a heat exchanger as described in Japanese Patent Application Publication No. 63-112065 is shown. As shown in the figures, a condenser 500 includes a plurality of adjacent, essentially flat tubes 11 having an oval cross-section and open ends which allow refrigerant fluid to flow therethrough. A plurality of corrugated fin units 12 are disposed between adjacent tubes 11. Flat tubes 11 and fin units 12 jointly form heat exchange region 100. Cylindrical header pipes 530 and 540 are disposed perpendicular to flat tubes 11 and may have, for example, a clad construction. The diameter and length of header pipes 530 and 540 are substantially equal to the thickness and height, respectively, of heat exchange region 100. Accordingly, header pipes 530 and 540 protrude only negligibly relative to heat exchange region 100 when the heat exchanger structure is assembled.

As shown in FIGS. 3 and 4, each of header pipes 530 and 540 includes an outer tube 13 which is preferably made of aluminum, and an inner tube 14, made of a metal material, which is brazed to the inner surface of outer tube 13. Outer tube 13 has a plurality of slots 15 disposed therethrough. Flat tubes 11 are fixedly connected to header pipes 530 and 540 and are disposed in slots 15 so that the open ends of flat tubes 11 communicate with the hollow interiors of header pipes 530 and 540. Inner tube 14 includes a plurality of portions **14*a* which define openings corresponding to slots 15. Portions 14*a* are brazed to the inner ends of flat tubes 11 and ensure that tubes 11 are hermetically sealed within header pipes 530 and 540 when the tubes are inserted in slots 15**.

Referring again to FIGS. 1 and 2, header pipe 530 has an open top end and a closed bottom end. An L-shaped pipe member **533*a* is positioned in the open top end of pipe 530, and is fixedly and hermetically connected thereto at one of its ends. The other end of L-shaped pipe member 533*a* is sealed by an inlet union joint 533*b* which is fixedly and hermetically connected to pipe member 533*a*. Inlet union joint 533*b* is linked to an outlet of an element (not shown) positioned upstream with respect to condenser 500, for example, a compressor, through a pipe member (not shown). Inlet union joint 533*b* and L-shaped pipe member 533*a* jointly form inlet union joint assembly 533**.

Header pipe 540 has a closed top end and an open bottom end. An L-shaped pipe member **543*a* is fixedly and hermetically connected at one of its ends to the open bottom end of header pipe 540. The other end of L-shaped pipe member 543*a* is sealed by an outlet union joint 543*b* which is fixedly and hermetically connected to pipe member 543*a*. Outlet union joint 543*b* is linked to an inlet of an element (not shown) positioned downstream with respect to condenser 500, for example, a receiver, through a pipe member (not shown). Outlet union joint 543*b* and L-shaped pipe member 543*a* jointly form outlet union joint assembly 543**.

As can be seen from the figures, inlet and outlet union joint assemblies 533 and 543 excessively protrude from heat exchange region 100 and header pipes 530 and 540 when condenser 500 is assembled as shown in FIGS. 1 and 2.

Still referring to FIG. 1, a partition wall **20*a* is fixedly disposed within header pipe 530 at a location about midway along its length and divides header pipe 530 into an upper cavity 531 and a lower cavity 532, which is isolated from upper cavity 531. A partition wall 30*a* is fixedly disposed within header pipe 540 at a location approximately one-third of the way along the length of header pipe 540 and divides header pipe 540 into an upper cavity 541 and a lower cavity 542, which is isolated from upper cavity 541. The location of partition wall 30*a* is lower than the location of partition wall 20*a***.

In operation, compressed refrigerant gas from an external compressor coupled to inlet union joint assembly 533 flows into upper cavity 531 of header pipe 530 through the inlet union joint assembly, and is distributed so that a portion of the gas flows through each of flat tubes 11 which is disposed above the location of partition wall **20*a*, and into an upper portion of upper cavity 541. Thereafter, the refrigerant in the upper portion of cavity 541 flows downwardly into a lower portion of upper cavity 541, and is distributed so that a portion of the refrigerant flows through each of flat tubes 11 disposed below the location of partition wall 20*a* and above the location of partition wall 30*a*, and into an upper portion of lower cavity 532 of header pipe 530. The refrigerant in the upper portion of lower cavity 532 then flows downwardly into a lower portion of lower cavity 532, and is again distributed so that a portion of the refrigerant flows through each of flat tubes 11 disposed below the location of partition wall 30*a*, and into lower cavity 542 of header pipe 540. As the refrigerant gas sequentially flows through flat tubes 11, heat from the refrigerant gas is exchanged with the atmospheric air flowing through corrugated fin units 12 in the direction of arrow W as shown in FIG. 5. Because the refrigerant gas radiates heat to the outside air, it condenses to a liquid state as it travels through tubes 11. The condensed liquid refrigerant in cavity 542 flows out of the cavity through outlet union joint assembly 543** and into an external receiver coupled to the joint assembly.

With reference to FIGS. 6 and 7, another prior art heat exchanger is shown. In the figures, the same reference numerals are used to denote corresponding elements shown in FIGS. 1–5. A complete explanation of these elements is, therefore, omitted. As shown in the figures, condenser 600 includes first and second header pipes 630 and 640 which are closed at both ends. An opening 631 is provided in first header pipe 630 between its upper closed end and partition wall **20*a*. A straight pipe member 633*a* is disposed in opening 631 and is fixedly and hermetically connected to first header pipe 630 to communicate with the hollow interior of the header pipe. The other end of straight pipe member 633*a* is sealed by an inlet union joint 633*b* which is fixedly and hermetically connected to the pipe member. Inlet union joint 633*b* and straight pipe member 633*a* jointly form inlet union joint assembly 633**.

An opening 641 is provided in second header pipe 640 between its lower closed end and partition wall **30*a*. An L-shaped pipe member 643*a* is disposed in opening 641 and is fixedly and hermetically connected to second header pipe 640 to communicate with the hollow interior of the header pipe. The other end of L-shaped pipe member 643a is sealed by an outlet union joint 643b which is fixedly and hermetically connected to the pipe member. Outlet union joint 643b and L-shaped pipe member 643a jointly form outlet union joint assembly 643**.

As can be seen from the figures, in this prior art arrangement, inlet and outlet union joint assemblies 633, 643 excessively protrude from the heat exchange region and header pipes 630 and 640 when condenser 600 is assembled as shown in FIGS. 6 and 7.

As described above, in the prior art structures, the inlet and outlet union joint assemblies excessively protrude from the heat exchange region and the header pipes when the condenser is assembled. Thus, when the condenser is installed in the engine compartment of an automobile, the inlet and outlet union joint assemblies may interfere with other components disposed within the engine compartment. Further, if the size of the condenser is reduced in order to prevent this interference, the heat exchange ability of the condenser is decreased as a result of the reduction in size of the heat exchange area.

SUMMARY OF THE INVENTION

It is an object of the present invention to provide a heat exchanger in which the amount of protrusion of inlet and outlet union joint assemblies from the heat exchange region and the header pipes is substantially reduced.

It is another object of the present invention to provide a heat exchanger in which interference between the inlet and outlet union joint assemblies and the other components disposed within the engine compartment of an automobile is minimized when the heat exchanger is installed in the engine compartment.

A heat exchanger in accordance with the present invention includes a plurality of tubes having opposite first and second open ends, and a plurality of fin units disposed between the tubes. The tubes and fin units jointly form a heat exchange region. First and second header pipes are fixedly and hermetically disposed at the opposite ends of each of the tubes so the tubes communicate with the interior of the header pipes. Each of the header pipes includes a linking member which links the heat exchanger to an external element of the refrigerant fluid circuit. The linking member comprises a block member which seals the open end of the header pipe, and is located at an inner side of a corner of the heat exchanger defined by the ends of the heat exchange region and the header pipe. A cavity is formed in the block member which opens to the interior of the header pipe, and communicates with at least one of the plurality of tubes. The cavity also opens to an outer surface of the block member to communicate with an external element of the refrigerant fluid circuit.

DETAILED DESCRIPTION OF THE PREFERRED EMBODIMENTS

Figure 1:
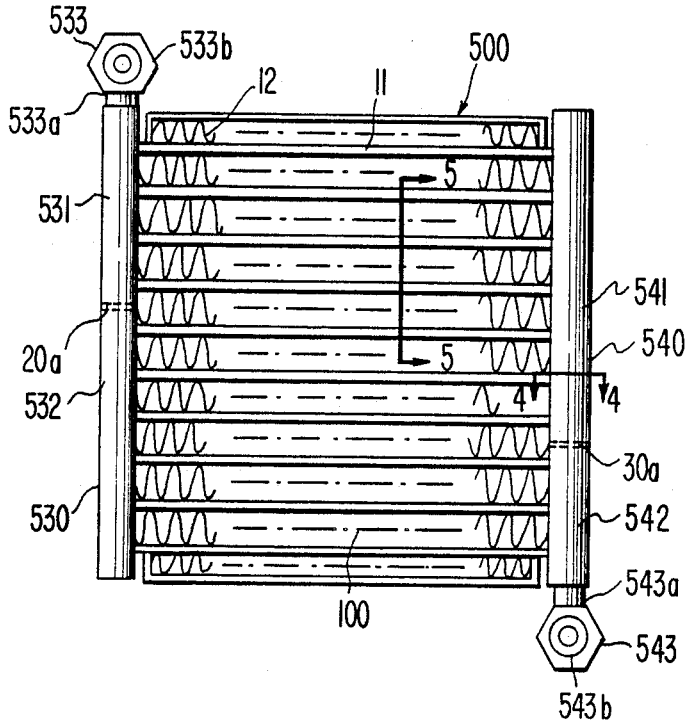
FIG. 1 (PRIOR ART)
FIG. 1 is an elevational view of a condenser in accordance with the prior art.
Figure 2:
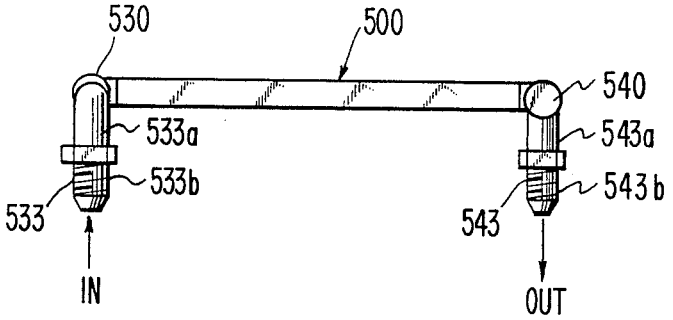
FIG. 2 (PRIOR ART)
FIG. 2 is a top view of the condenser shown in FIG. 1.
Figure 3:
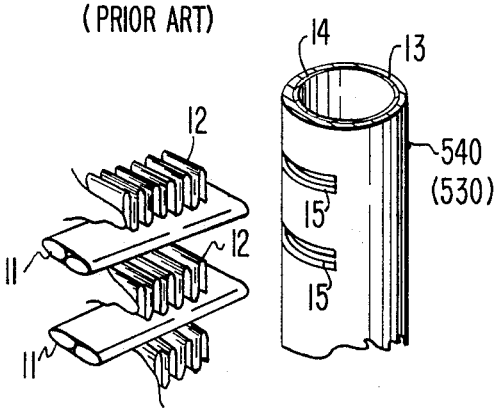
FIG. 3 (PRIOR ART)
FIG. 3 is a perspective view of certain elements of the condenser shown in FIG. 1.

With reference to FIGS. 8–12, the construction of a heat exchanger, and in particular, a condenser, in accordance with a first embodiment of the present invention is shown. In the figures, the same numerals are used to denote corresponding elements shown in FIGS. 1–7. A complete explanation of these elements is, therefore, omitted. Condenser 10 includes a first header pipe 20 having an open top end and a closed bottom end, and a second header pipe 30 having a closed top end and an open bottom end. The open top end of first header pipe 20 is sealed by a rectangular parallelpiped block 40. First header pipe 20 and block 40 jointly form first header pipe assembly 200.

The open bottom end of second header pipe 30 is sealed by a second rectangular parallelpiped block 50, which is substantially identical to block 40. Second header pipe 30 and block 50 jointly form second header pipe assembly 300. Hereinafter, first header pipe assembly 200 only is described inasmuch as second header pipe assembly 300 is substantially identical.

Figure 11:
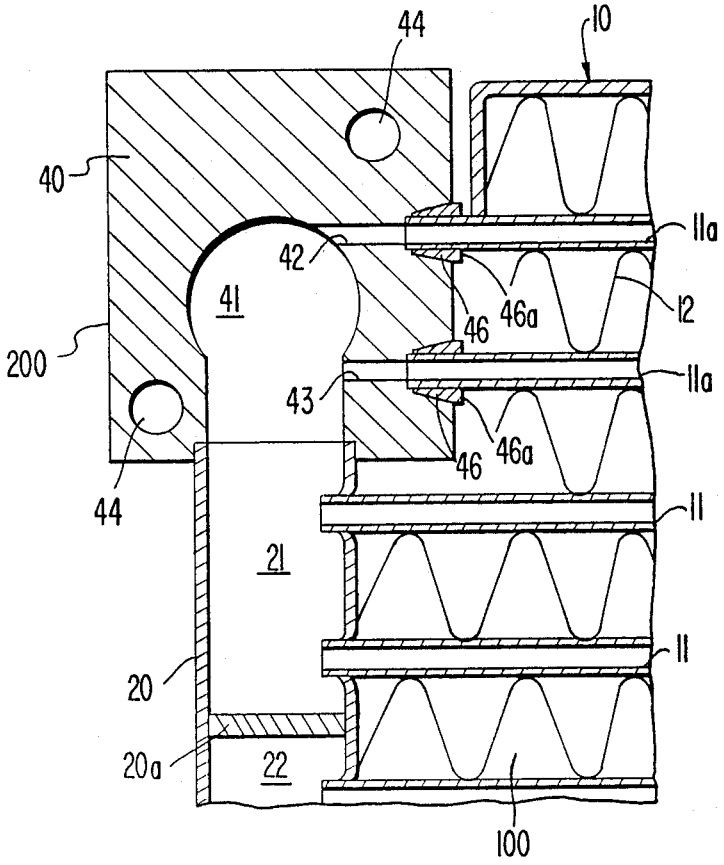
FIG. 11 is a vertical sectional view of the structure shown in FIG. 10.
Figure 12:
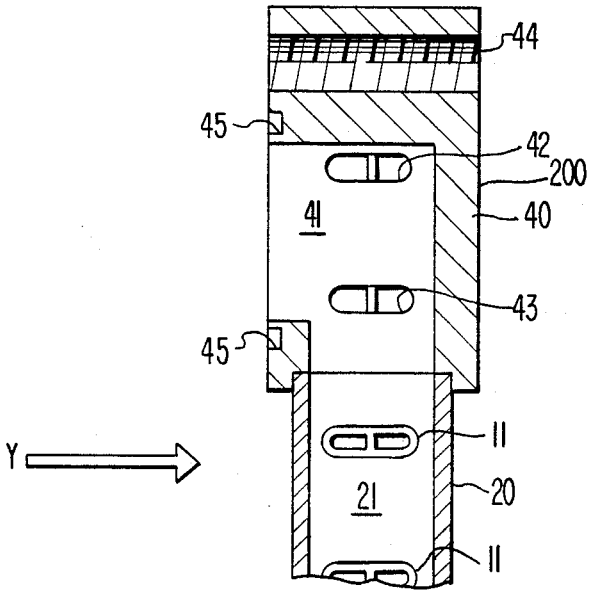
FIG. 12 is a sectional view taken along line 9—9 of FIG. 10.

As shown in FIGS. 11 and 12, an L-shaped cylindrical cavity 41 is formed in block 40. One end of L-shaped cylindrical cavity 41 opens to a front side surface of block 40, and the other end of cavity 41 opens to a bottom surface of block 40. Holes 42 and 43 having an oval cross-section are formed in block 40, and are parallel to each other in the horizontal direction. Each of holes 42 and 43 opens to cavity 41 at one end, and the other end of holes 42 and 43 opens to an inner side surface of block 40, thus, allowing cavity 41 to communicate with the interior of flat tubes 11a, as will be explained. A pair of holes 44 having a female screw portion therein are formed in block 40 perpendicular to the front side surface of block 40, and a circular groove 45 is formed in the front side surface of block 40. The open end of first header pipe 20 is fixedly and hermetically secured to the bottom surface of block 40 so that the hollow interior of first header pipe 20 communicates with cavity 41.

Figure 4:
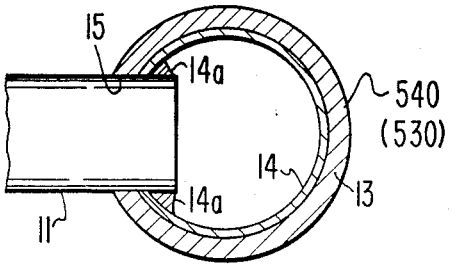
FIG. 4 (PRIOR ART)
FIG. 4 is a partial cross-sectional view taken along line 4—4 of FIG. 1.
Figure 5:
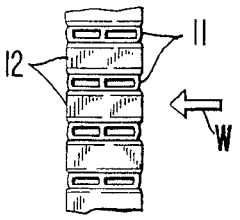
FIG. 5 (PRIOR ART)
FIG. 5 is a partial cross-sectional view taken along line 5—5 of FIG. 1.
Figure 6:
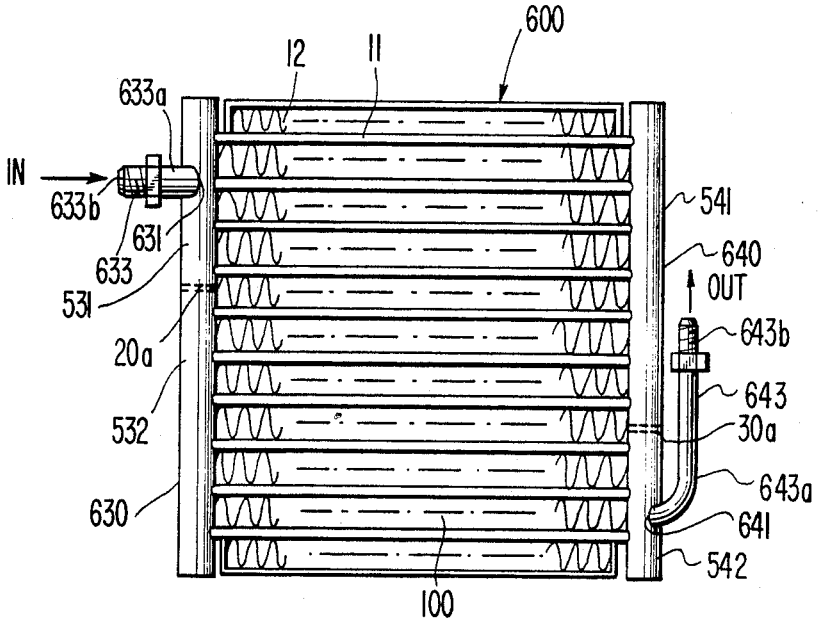
FIG. 6 (PRIOR ART)
FIG. 6 is an elevational view of another prior art condenser.
Figure 7:
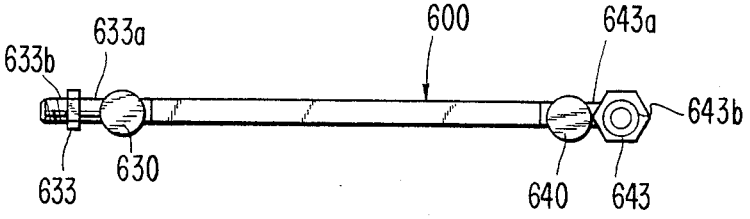
FIG. 7 (PRIOR ART)
FIG. 7 is a top view of the condenser shown in FIG. 6.
Figure 8:
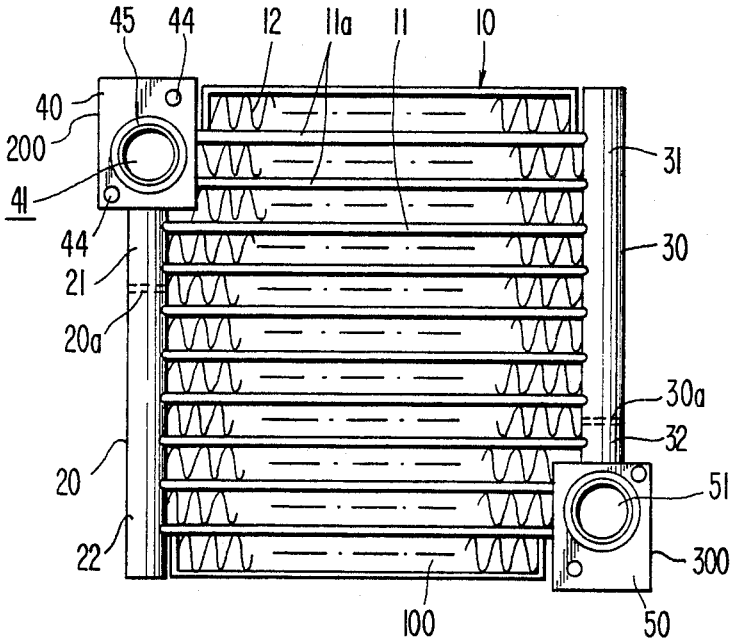
FIG. 8 is an elevational view of a condenser in accordance with a first embodiment of the present invention.
Figure 9:
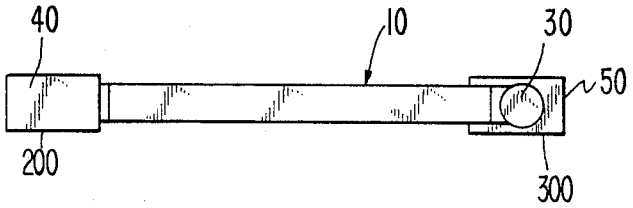
FIG. 9 is a top view of the condenser shown in FIG. 8.
Figure 10:
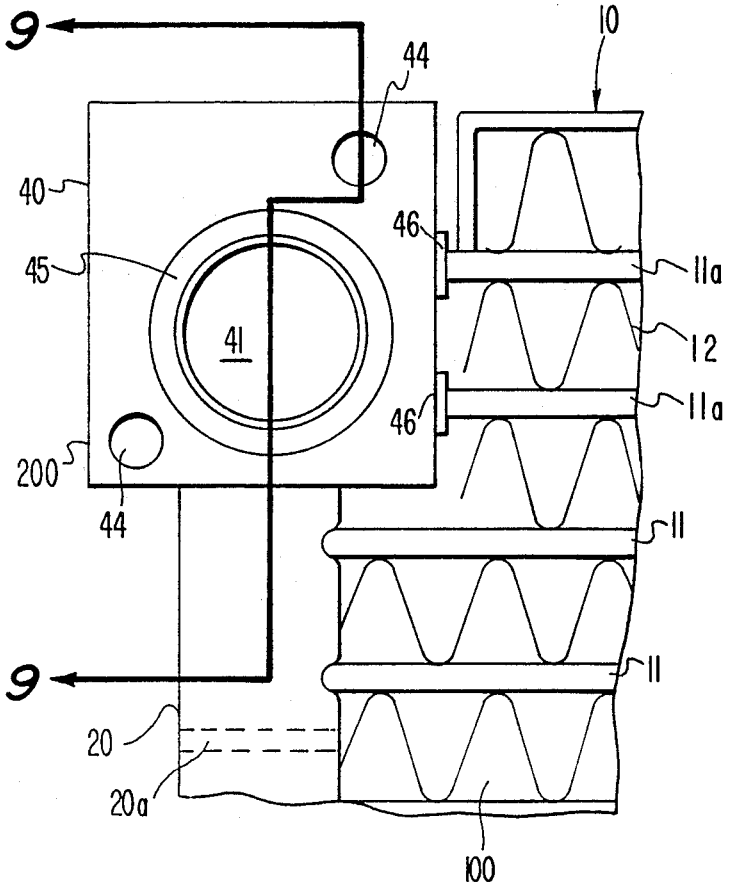
FIG. 10 is an enlarged elevational view of a portion of the condenser shown in FIG. 8.

A plurality of adjacent and parallel flat tubes 11 having open ends are disposed perpendicular to first header pipe assembly 200 and second header pipe assembly 300. One end of the two uppermost located tubes 11*a* are fixedly and hermetically inserted into holes 42 and 43, respectively, through sleeves 46 having a flange portion 46*a* at one end thereof, all as shown in FIG. 11. The ends of the other tubes 11 are fixedly disposed in header pipes 20 and 30 as shown in FIG. 4 so that tubes 11 are in fluid communication with the hollow interiors of the header pipes. Corrugated fin units 12 are disposed between adjacent flat tubes 11 and 11*a*. Tubes 11, 11*a* and fin units 12 jointly form heat exchange region 100. The various components of condenser 10 are joined together by brazing.

Figure 13:
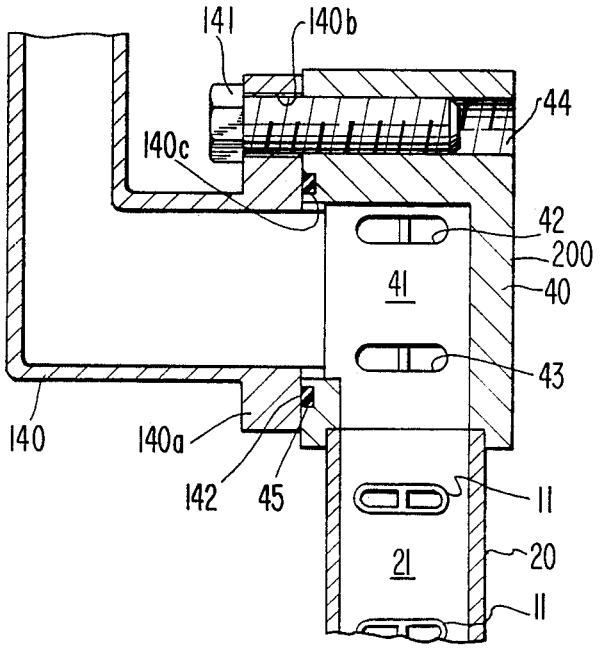
FIG. 13 is a view similar to FIG. 12. In the drawing, one end of a pipe member is firmly secured to the portion of the condenser shown in FIG. 10.

With reference to FIG. 13, first header pipe assembly 200 and pipe member 140 which is used for linking condenser 10 to an external element (not shown) located upstream with respect to the condenser, for example, a compressor, are shown. Pipe member 140 includes a flange portion 140*a* which faces the front side surface of block 40. A pair of holes 140*b* (only one hole is shown in FIG. 13) are formed through flange portion 140*a* and align with holes 44 when opening end 140*c* of pipe member 140 is inserted into cavity 41. A pair of bolts 141 (only one bolt is shown in FIG. 13) are screwed into holes 44 through holes 140*b* to firmly secure pipe member 140 to the front side surface of block 40. An O-ring seal 142 is disposed within circular groove 45 to seal the mating surfaces of flange portion 140*a* and block 40.

In operation of condenser 10, compressed refrigerant gas from an external compressor flows into cavity 41 and upper cavity 21 of first header pipe 20 through pipe member 140, and is distributed so that a portion of the gas flows through each of flat tubes 11*a* and 11 which is disposed above the location of partition wall 20*a*, and into an upper portion of upper cavity 31 of second header pipe 30. Thereafter, the refrigerant in the upper portion of cavity 31 flows downwardly into a lower portion of upper cavity 31, and is distributed so that a portion of the refrigerant flows through each of flat tubes 11 disposed below the location of partition wall 20*a* and above the location of partition wall 30*a*, and into an upper portion of lower cavity 22 of first header pipe 20. The refrigerant in the upper portion of lower cavity 22 flows downwardly into a lower portion of cavity 22, and is again distributed so that a portion of the refrigerant flows through each of flat tubes 11 disposed below the location of partition wall 30*a*, and into lower cavity 32 of second header pipe 30. As the refrigerant gas flows through flat tubes 11, heat from the refrigerant gas is exchanged with the atmospheric air flowing through corrugated fin units 12 in the direction of arrow Y as shown in FIG. 12. Because the refrigerant gas radiates heat to the outside air, it condenses to a liquid state as it travels through tubes 11*a* and 11. The liquid refrigerant in cavity 32 flows into L-shaped cylindrical cavity 51 and from there flows out through a pipe member (not shown) similar to pipe member 140 and into a receiver coupled to the pipe member.

Figure 14:
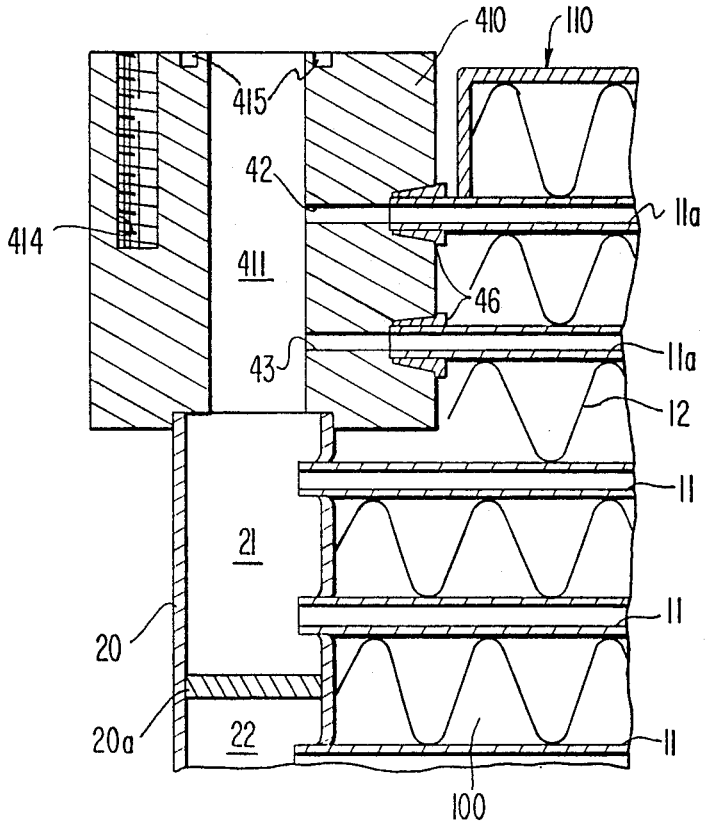
FIG. 14 is a view similar to FIG. 11 illustrating a portion of a condenser in accordance with a second embodiment of the present invention.
Figure 15:
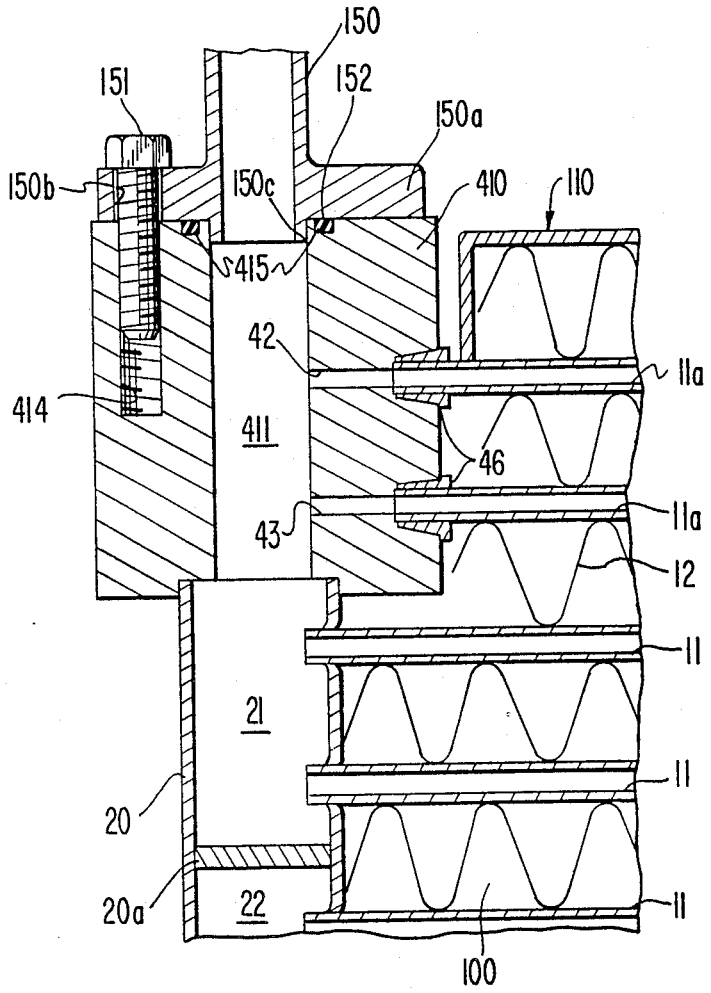
FIG. 15 is a view similar to FIG. 13. In the drawing, one end of a pipe member is firmly secured to the portion of the condenser shown in FIG. 14.

With reference to FIGS. 14 and 15, a portion of a condenser in accordance with a second embodiment of the present invention is shown. In the second embodiment, condenser 110 includes a rectangular parallelpiped block 410 having a cylindrical cavity 411 formed therein. One end of cylindrical cavity 411 opens to a bottom side surface of block 410 to allow communication between the hollow interior of first header pipe 20 and cavity 411. A pair of holes 414 (only one is shown in FIG. 14) having a female screw portion therein are formed in block 410 and are disposed parallel to first header pipe 20. One end of holes 414 opens to the top side surface of block 410. A circular groove 415 is formed in the top side surface of block 410. As shown in FIG. 15, pipe member 150 used for linking condenser 110 to an external compressor is secured to block 410. Pipe member 150 includes a flange portion 150*a* which faces the top side surface of block 410. A pair of holes 150*b* (only one hole is shown in FIG. 15) are formed through flange portion 150*a* and align with holes 414 when the opening end 150*c* of pipe member 150 is inserted into cavity 411. A pair of bolts 151 (only one bolt is shown in FIG. 15) are screwed into holes 414 through holes 150*b* to firmly secure pipe member 150 to the top side surface of block 410. An O-ring seal 152 is disposed within circular groove 415 to seal the mating surfaces of flange portion 150*a* and block 410.

Figure 16:
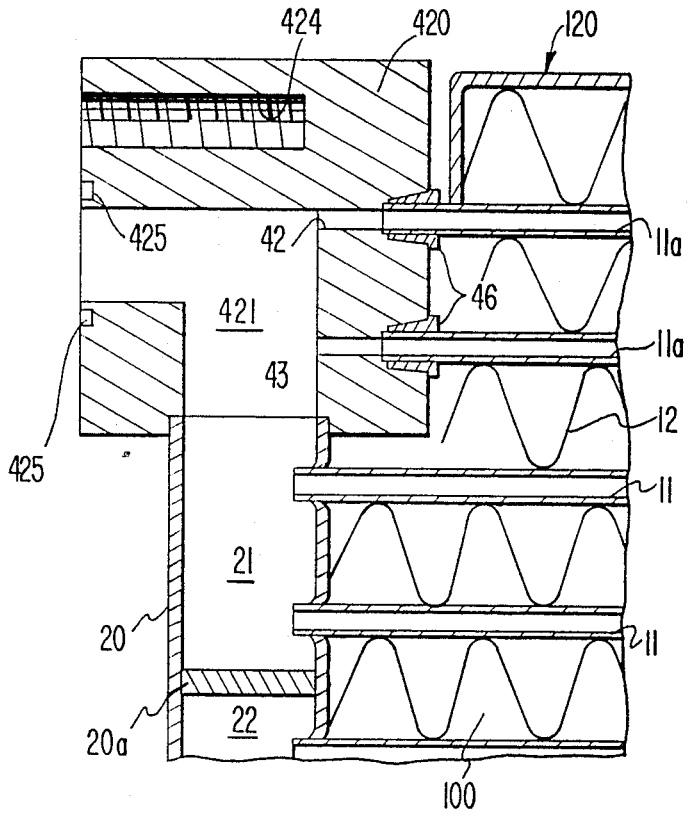
FIG. 16 is a view similar to FIG. 11 illustrating a portion of a condenser in accordance with a third embodiment of the present invention.
Figure 17:
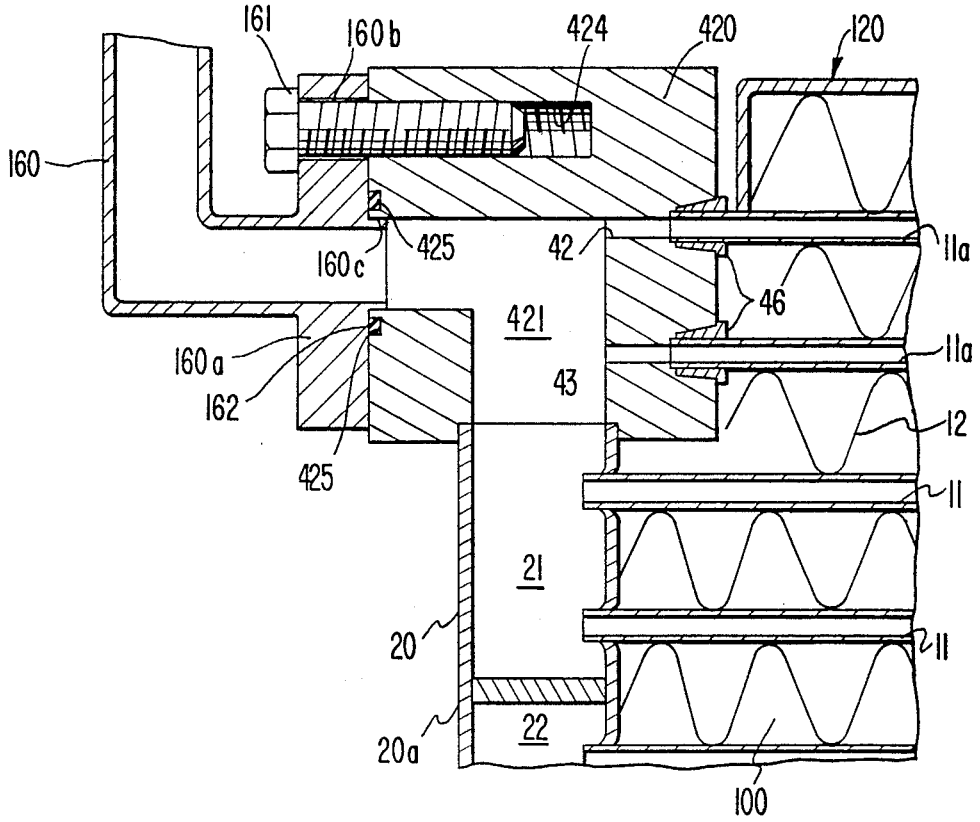
FIG. 17 is a view similar to FIG. 13. In the drawing, one end of a pipe member is firmly secured to the portion of the condenser shown in FIG. 16.

With reference to FIGS. 16 and 17, a portion of a condenser in accordance with a third embodiment of the present invention is shown. In the third embodiment, condenser 120 includes a rectangular parallelpiped block 420 having an L-shaped cylindrical cavity 421 formed therein. One end of L-shaped cylindrical cavity 421 opens to an outer side surface of block 420 opposite heat exchange region 100, and the other end of cavity 421 opens to a bottom side surface of block 420 to allow communication between the hollow interior of first header pipe 20 and cavity 421. A pair of holes 424 (only one hole is shown in FIG. 16) having a female screw portion are formed in block 420, and communicate at one end with the outer side surface of block 420. A circular groove 425 is formed in the outer side surface of block 420. As shown in FIG. 17, pipe member 160 used for linking condenser 120 to an external compressor is secured to block 420. Pipe member 160 includes a flange portion 160*a* which faces the outer side surface of block 120. A pair of holes 160*b* (only one hole is shown in FIG. 17) are formed through flange portion 160*a* and are aligned with holes 424 when the opening end 160*c* of pipe member 160 is inserted into cavity 421. A pair of bolts 161 (only one bolt is shown in FIG. 17) are screwed into holes 424 through holes 160*b* to firmly secure pipe member 160 to the outer side surface of block 420. An O-ring seal 162 is disposed within circular groove 425 to seal the mating surfaces of flange portion 160*a* and block 420.

Figure 18:
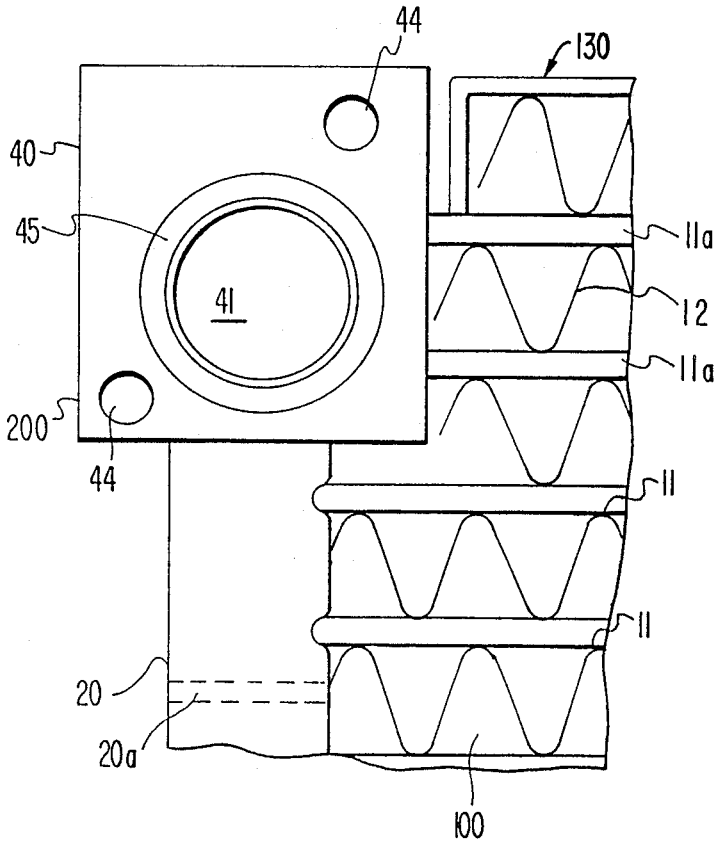
FIG. 18 is a view similar to FIG. 10 illustrating a portion of a condenser in accordance with a fourth embodiment of the present invention.

With reference to FIG. 18, a portion of a condenser in accordance with a fourth embodiment of the present invention is shown. The fourth embodiment is substantially similar to the first embodiment shown in FIGS. 8–12 except that flat tubes 11*a* are directly inserted into holes 42 and 43, and are fixedly and hermetically secured to the inner walls of holes 42 and 43. Thus, in this embodiment, sleeves 46 are eliminated.

I claim:

1. In a heat exchanger for a refrigerant fluid circuit, said heat exchanger comprising a plurality of tubes having opposite first and second open ends, a plurality of fin units disposed between said plurality of tubes, said tubes and fin units jointly forming a heat exchange region, first and second header pipes, each of said header pipes having an open end and fixedly and hermetically coupled to one of said opposite ends of each of said tubes to allow said tubes to communicate with the interior of said header pipes, at least one of said header pipes having means for linking said heat exchanger to an external element of said refrigerant fluid circuit, the improvement comprising:

said linking means including a block member located at an inner side of a corner of the heat exchanger defined by the open end of one of said first and second header pipes and said heat exchange region for sealing the open end of said one of said first and second header pipes, said block member having a cavity formed therein, said cavity opening to the interior of said one of said first and second header pipes, and communicating with the interior of at least one of said tubes, said cavity further opening to an outer surface of said block member to communicate with said external element of said refrigerant fluid circuit.

2. The heat exchanger of claim 1 wherein said block member is a rectangular parallelpiped.

3. The heat exchanger of claim 2 wherein the thickness of said block member is substantially equal to the thickness of said heat exchange region.

4. The heat exchanger of claim 2 wherein said cavity opens to one of the side surfaces of said block member parallel to a front surface of said heat exchange region.

5. The heat exchanger of claim 2 wherein said cavity opens to a top side surface of said block member opposite said heat exchange region.

6. The heat exchanger of claim 2 wherein said cavity opens to an outer side surface of said block member opposite said heat exchange region.

7. The heat exchanger of claim 4 wherein at least one hole having a female screw portion is formed in said one of side surfaces of said block member perpendicular to said front surface of said heat exchange region.

8. The heat exchanger of claim 5 wherein at least one hole having a female screw portion is formed in said top side surface of said block member parallel to said first and second header pipes.

9. The heat exchanger of claim 6 wherein at least one hole having a female screw portion is formed in said outer side surface of said block member perpendicular to said first and second header pipes.

10. The heat exchanger of claim 7 further comprising a pipe member fixedly and hermetically connected at one of its ends to said one of said side surfaces of said block member and fastening means for connecting said pipe member to said block member, said pipe member having its other end linked to said external element of said refrigerant fluid circuit.

11. The heat exchanger of claim 10 wherein said fastening means comprises at least one bolt which is screwed into said female screw portion of said hole.

12. The heat exchanger of claim 8 further comprising a pipe member fixedly and hermetically connected at one of its ends to said top side surface of said block member and fastening means for connecting said pipe member to said block member, said pipe member having its other end linked to said external element of said refrigerant fluid circuit.

13. The heat exchanger of claim 12 wherein said fastening means comprises at least one bolt which is screwed into said female screw portion of said hole.

14. The heat exchanger of claim 9 further comprising a pipe member fixedly and hermetically connected at one of its ends to said outer side surface of said block member and fastening means for connecting said pipe member to said block member, said pipe member having its other end linked to said external element of said refrigerant fluid circuit.

15. The heat exchanger recited in claim 14 wherein said fastening means comprises at least one bolt which is screwed into said female screw portion of said hole.

16. The heat exchanger of claim 1 wherein said heat exchanger is a condenser.

* * * * *